US005521678A

United States Patent [19]

Riehle et al.

[11] Patent Number: 5,521,678

[45] Date of Patent: May 28, 1996

[54] ELECTROSTATOGRAPHIC IMAGING DRUM HAVING A PERIPHERY FLUSH WITH PERIPHERY OF AN END CAP

[75] Inventors: James D. Riehle, Ontario; Eugene A. Swain, Webster; David J. Maty, Ontario; William A. Hammond; James M. Markovics, both of Rochester; David R. McCandless, Ontario, all of N.Y.

[73] Assignee: Xerox Corporation, Stamford, Conn.

[21] Appl. No.: 170,592

[22] Filed: Dec. 21, 1993

[51] Int. Cl.[6] ..... G03G 15/00

[52] U.S. Cl. ..... 355/211; 355/200; 430/32; 430/56

[58] Field of Search ..... 355/211, 210, 355/200, 213, 219, 245, 296, 299, 301; 430/31, 32, 46, 56, 80

[56] References Cited

U.S. PATENT DOCUMENTS

| | | | |
|---|---|---|---|
| 1,092,464 | 4/1914 | Watson et al. | 384/565 |
| 3,994,053 | 11/1976 | Hunt | 355/211 X |
| 4,105,345 | 8/1978 | Van Wagner . | |
| 4,120,576 | 10/1978 | Babish | 355/200 |
| 4,400,077 | 8/1983 | Kozuka et al. | 355/211 |
| 4,561,763 | 12/1985 | Basch . | |
| 4,639,122 | 1/1987 | Pease | 355/299 |
| 4,914,478 | 4/1990 | Yashiki | 355/211 |
| 4,929,524 | 5/1990 | Sakai et al. | 430/56 |
| 5,023,660 | 6/1991 | Ebata et al. | 355/200 |
| 5,052,090 | 10/1991 | Kitaura et al. | 355/211 X |
| 5,313,255 | 5/1994 | Taniguchi et al. | 355/211 |
| 5,357,328 | 10/1994 | Lundy | 355/301 |

FOREIGN PATENT DOCUMENTS

| | | |
|---|---|---|
| 5885547 | of 0000 | Japan . |
| 5887579 | of 0000 | Japan . |
| 5886552 | of 0000 | Japan . |
| 5886585 | of 0000 | Japan . |
| 56-527701 | 3/1981 | Japan . |

*Primary Examiner*—Sandra L. Brase

[57] ABSTRACT

An electrostatographic imaging member assembly comprising a hollow electrostatographic imaging drum having a first end and a second end, at least one coating on the drum extending from the first end of the drum to the second end of the drum, the coating having an outer electrostatographic imaging surface, drum supporting hubs mounted on the first end of the drum and the second end of the drum, the drum supporting hubs comprising a disk shaped member comprising a disk shaped segment having an exposed annular landing strip surface parallel to and flush with the electrostatographic imaging surface, the annular landing strip surface having a width of at least about 3 millimeters and having an imaginary axis coextensive with an imaginary axis of the drum. The electrostatographic imaging member assembly may be utilized in electrostatographic imaging apparatus in which the hubs support electrostatographic imaging apparatus subassembly components. The electrostatographic imaging member assembly is fabricated by coating the entire external surface of the substrate and mounting the hubs to the ends of the resulting coated substrate.

7 Claims, 1 Drawing Sheet

ELECTROSTATOGRAPHIC IMAGING DRUM HAVING A PERIPHERY FLUSH WITH PERIPHERY OF AN END CAP

BACKGROUND OF THE INVENTION

This invention relates in general to drum support apparatus and more specifically to a drum supporting hub, a drum assembly containing the hub and method for fabricating the drum assembly.

Electrostatographic imaging drums are well known in the art. These drums comprise a hollow cylindrical substrate and at least one electrostatographic coating. These drums are usually supported by a hub held in place at the end of each drum by a flange extending from the hub into the interior of the drum and retained in place by an interference fit and/or an adhesive. An axle shaft through a hole in the center of each hub supports the hub and drum assembly. Since some electrostatographic imaging drums and their supporting hardware may have slight tolerance deviations or may become imperfect due to wear, these drums tend to wobble when rotated around their axle shaft. Such wobble is undesirable where precise spacing is required between the electrostatographic coating on the drum and various subsystems of the imaging system such as developing, cleaning and charging substations. In order to achieve uniform spacing between the imaging apparatus subsystems and the imaging surface of the drum, one may utilize spacing or support elements extending from the subsystems such as struts, shoes, or wheels which actually ride on the drum surface. Thus, any wobbling movement of the drum will merely allow the subsystem to to continue to maintain its position relative to the adjacent surface of the drum as the drum wobbles during rotation. The use of spacing or support elements extending from electrostatographic subsystems to ride directly on a drum surface is well known in the art and is disclosed, for example, in U.S. Pat. Nos. 3,869,203 and 3,998,184. The disclosures of these patents are incorporated herein in their entirety.

One common technique for fabricating these electrostatographic imaging drums involves dip coating the drum into a coating bath to form a dielectric layer for electrographic imaging members or to form at least one electrophotographic layer for electrophotographic imaging members. The electrophotographic imaging layer may be single electrophotographic imaging layer or comprise two or more layers such as a charge generation layer and a charge transport layer. All of these electrostatographic imaging layers are well known and conventional. During the dip coating process, one end of the drum substrate is vertically submerged with the axis of the drum substrate maintained in a vertical orientation until most or all of the external drum substrate surface is coated with the coating solution. Dip coating of electrostatographic imaging drums are well known in the art. Since the upper boundary of the applied coating layer tends to have a nonuniform thickness, the electrical properties thereat are also nonuniform. This problem is minimized by bringing the coating to the top of the substrate during dip coating so that the region actually utilized for electrostatic imaging is spaced away from the coating boundary. Since at least the bottom end of the substrate is coated and, in the latter situation, the upper end is also coated, difficulties are encountered when subsystems employed in cooperation with the electrostatographic imaging drum are spaced from the imaging surface of the electrostatic imaging drum by spacing means that ride on one or both ends of the drum to achieve more accurate spacing tolerances. As described above, these spacing means achieve spacing tolerances by compensating for situations where the drum wobbles as it rotates.

The spacing means which ride on the surface of the drum usually comprise a strut fitted with a roller or low friction foot. Such spacing means are well known in the art and are described, for example, in U.S. Pat. Nos. 3,869,203 and 3,998,184, referred to above. As the drum is rotated through many imaging cycles, the spacing means causes erosion of the coating on the drum substrate in the regions contacted by the spacing means and the resulting eroded coating debris forms an undesirable dust which settles on critical surfaces within the machine such as the imaging surface, corona wires, optic system components, and the like. To avoid this problem, the coating on at least one end of the drum (if the other end remains uncoated) is removed prior to installation of the drum in an electrostatographic imaging machine such as a copier, duplicator, printer or the like. Attempts to remove the coating with the aid of solvents can cause solvent splashing or fumes which can damage areas of the coating which are to be subsequently utilized for imaging. Also, solvent removal is usually employed in combination with a wiping means such as a brush or pad which are unreliable and often fail to remove all of the coating material at the end of the imaging drum. Moreover, disposal or recovery of the solvent can be hazardous, time consuming and expensive. The coating can also be removed by use of a laser beam, but such laser systems are also complex and expensive. Moreover, the solvent/wiping or laser systems for removal of coatings are bulky and prevent achievement of high substrate population density for efficient coating and cleaning operations. Masking techniques may also be employed to remove deposited coatings from the ends of drum substrates. More specifically, a masking tape may be applied to the end or ends of a drum substrate to allow the coating to deposit on the tape instead of on the underlying substrate. The coating deposited on the tape is removed when the tape is stripped from the substrate after the coating operation. These operations all adversely affect production costs, factory floor space requirements and the like. After the coating material has been removed from at least one end of a coated drum, a hub is installed to support the drum on an axle shaft for rotation in an electrostatographic imaging machine.

The requirement that the ends of a electrostatographic imaging drum carry a bare strip at each end reduces the amount of productive area on the exterior surface of the drum available for forming images. Thus, the drum is usually longer than is actually needed for formation of electrostatographic images. This increases drum material costs and leads to greater packaging, shipping and storage space requirements and expenses. Moreover, electrostatographic coating material is wasted because it is deposited at one or both ends of the drum and thereafter removed to provide a suitable surface for the subsystem support means.

When a bare strip is formed on the drum by removal of coatings adjacent to the end or ends of the electrostatographic imaging member to expose the underlying substrate, cycling of such an imaging member during an imaging process involving steps such as liquid development and wiping to clean the imaging surface tends to expose the edges of the electrostatographic coating, particularly any underlying more vulnerable layers, to solvent used in the liquid ink developer thereby causing deterioration of the layers and degradation of the imaging capabilities of the electrostatographic imaging member. Also, the bare strips are eroded by the spacing means during extensive image cycling and renders the used drum unsuitable for simple recycling.

Hubs have also been used which have a peripheral support surface to space subsystems from the imaging surface of a thin electroformed electrostatic imaging drum by allowing a subsystem spacing means to ride on the peripheral support surface or support ring of the hub. The hub is held in place by press fitting a flange extending from the hub into the interior of the drum. This type of hub is described in Japanese Patent Publication 58-87579, published May 5, 1983. However, the outermost periphery of the hub disclosed in Japanese Patent Publication 58-87579 is in the shape of a flange which extends above the surface of a thin-walled, electroformed tube. This hub flange abuts against the electroformed tube which has an outside diameter much smaller than the diameter of the hub flange. The corner formed at the intersection of the drum and the abutting flange can collect toner and other debris during image cycling until the accumulation of debris becomes so large that it dislodges and migrates to and contaminates critical components of the imaging system such as imaging surfaces, optical components, corona wires and the like. Cleaning the intersection with conventional cleaning devices can encounter difficulties such as collisions between the abutting flange of the hub and fragile cleaning blades. Repeated collisions will damage the cleaning blade, reduce its cleaning efficiency and shorten overall life.

Thus, there is a continuing need for improved photoreceptors that are more reliable and simpler to fabricate.

INFORMATION DISCLOSURE STATEMENT

Japanese Patent Publication 58-87579, published May 25, 1983—A drum assembly is disclosed wherein an electroformed thin cylinder coated with photosensitive coating is fitted at each end with support rings having an exposed outer perimeter having a surface which supports rotating wheels. A device is held in position spaced from the photoconductive coating by the rotating wheels as they ride on the peripheral surface of the support rings.

U.S. Pat. No. 4,561,763 to D.C. Basch issued on Dec. 31, 1985—A drum supporting hub is disclosed having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. Preferably, the height of the lips is flush with the outer surface of cylindrical drum when the drum supporting hub is fully inserted into cylindrical drum. This flush surface permits cams, seals or other mechanical means in an electrophotographic imaging apparatus to ride slightly off the edge of the cylindrical drum without interference by lip 30. The drum supporting hub is employed in a drum assembly comprising the hub, a cylindrical drum having a circular cross section and a shaft positioned along the axis of the drum.

Japanese Patent Publication 58-86552 to H. Tokunaga, published May 24, 1983—A light weight drum-shaped image retaining body capable of regulating the temperature by forming a drum-shaped substrate with an endless belt having a 0.2–2 mm thickness manufactured by an electroforming method and by attached a heating element inside of the substrate is disclosed. The substrate is supported around the shaft by means of flanges. A photoconductive layer of Se—Te is vacuum-deposited on the substrate and a heating element and thermostat are attached to the inside of the substrate.

Japanese Patent Publication 58-86585 to Y. Fujimaki, published May 24, 1983— A light weight drum is disclosed free of mechanical deformation by forming a drum-like image carrier of an endless belt manufactured by electroforming. The endless belt is supported on a shaft with flanges and an auxiliary member located within the interior of the belt. A Se—Te layer is formed by vacuum deposition on the cylindrical base body to obtain a drum-like image carrier.

Japanese Patent Publication 58-85547 to Y. Fujimaki, published May 24, 1983—A long cylindrical base body is manufactured by electroforming and thereafter cut into desired lengths. For example, a long-sized cylinder made of thin aluminum and vinyl chloride or a seamless long-sized nickel cylinder is coated with: 1. a photosensitive layer using an inorganic photoconductive material such as CdS and an organic photoconductive material such as polyvinyl carbazole formed by vapor-depositing Se or Te with an undercoating are necessary. The cylinder is then cut to the desired length to obtain individual photosensitive cylinders. Detachable flange members are fitted on a shaft at both ends of an individual cylinder to make the sections regularly circular to obtain a photosensitive drum. Each photosensitive drum has photosensitive layers similar to other parts even at the peripheral parts, and variants of performance and quality among photosensitive drums is eliminated.

U.S. Pat. No. 4,105,3458 to E. Van Wagner, issued Aug. 8, 1978—A drum support apparatus is disclosed including a drum with webs adapted to be fitted within grooves located on the interior of the drum. The webs are supported on a shaft that is cantilevered from a machine frame and have adjustable lugs attached thereto that fit within the grooves on the interior of the drum in order to maintain the outside surface of the drum concentric with the shaft and thereby reduce the possibility of drum runout. The photosensitive coating 11 shown on the drawings has an inboard end bell 22 and tapered mating portions 28 being adapted to partially close the end of the drum.

SUMMARY OF THE INVENTION

It is, therefore, an object of the present invention to provide an improved drum supporting hub and drum assembly which overcomes the above-noted disadvantages.

It is another object of this invention to provide an improved drum supporting hub and drum assembly which have been coated from one end to the other whereby the electrical properties of the coating in the imaging region are uniform.

It is another object of this invention to provide an improved drum supporting hub and drum assembly which permits utilization of almost its entire outer surface for imaging.

It is a further object of this invention to provide an improved drum supporting hub and drum assembly which eliminates a need for solvent recovery or disposal.

It is still another object of this invention to provide an improved drum supporting hub and drum assembly which is more reliable and efficient.

It is a further object of this invention to provide an improved drum supporting hub and drum assembly which eliminates a fabrication process step.

It is another object of this invention to provide an improved drum supporting hub and drum assembly that enables safer techniques for fabricating coated electrostatographic imaging members.

It is still another object of this invention to provide an improved drum supporting hub and drum assembly which permits the use of shorter drums.

It is a further object of this invention to provide an improved drum supporting hub and drum assembly which eliminates the need for masking and unmasking substrates during coating operations.

It is another object of this invention to provide an improved drum supporting hub and drum assembly that accommodates changes in substrate diameters without any need for bulky equipment for the removal of coating from the ends of substrates having different diameters.

It is still another object of this invention to provide an improved drum supporting hub and drum assembly which allows closer center-to-center substrate spacings during dip coating because coating edge removal subsystems have been eliminated from the coating apparatus.

It is yet another object of this invention to provide an improved drum supporting hub and drum assembly which reduces the number of assembly steps utilized to manufacture an electrostatographic drum.

The foregoing and other objects of the present invention are accomplished by providing an electrostatographic imaging member assembly comprising a hollow electrostatographic imaging drum having a first end and a second end, at least one coating on the drum extending from the first end of the drum to the second end of the drum, the coating having an outer electrostatographic imaging surface, drum supporting hubs mounted on the first end of the drum and the second end of the drum, the drum supporting hubs comprising a disk shaped member comprising a disk shaped segment having an exposed annular landing strip surface parallel to and flush with the electrostatographic imaging surface, the annular landing strip surface having a width of at least about 3 millimeters and having an imaginary axis coextensive with an imaginary axis of the drum. The electrostatographic imaging member assembly may be utilized in electrostatographic imaging apparatus in which the hubs support electrostatographic imaging apparatus subassembly components. The electrostatographic imaging member assembly is fabricated by dip or spray coating the entire external surface of the substrate and mounting the hubs to the ends of the resulting coated substrate.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices or components thereof.

DETAILED DESCRIPTION OF THE DRAWINGS

The present invention may be employed in any suitable device that requires support for a drum. However, for purposes of illustration, the invention will be described with reference to an electrostatographic imaging system. A typical electrophotographic imaging system is illustrated in U.S. Pat. No. 3,900,258 to R. F. Hoppner et al and U.S. Pat. No. 3,998, 184 to D. H. Hudson, the entire disclosures thereof being incorporated herein by reference.

Figure 1:
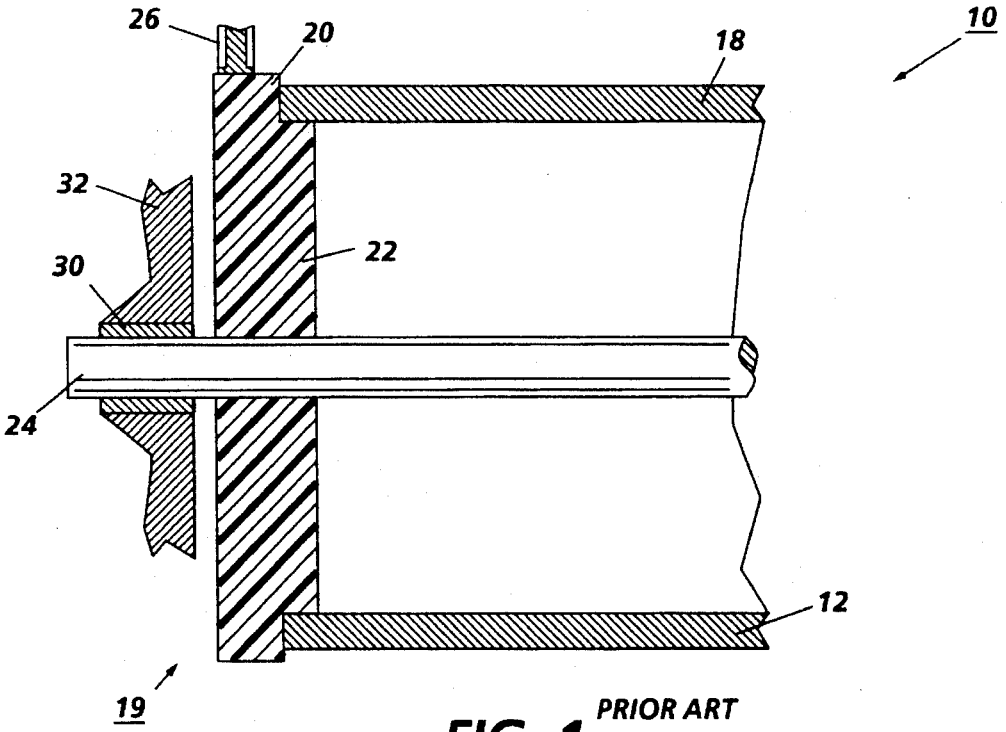
FIG. 1 PRIOR ART
FIG. 1 is a schematic illustration of an electrostatographic imaging member assembly of the prior art.

Referring to FIG. 1, a prior art electrostatographic imaging member assembly 10 is illustrated comprising a hollow electrostatographic imaging drum 12 having an outer surface 18. A drum support hub 19 comprising a disk shaped flange 20 is pressed fitted into one end of hollow electrostatographic imaging drum 12. Drum support hub 19 has an exposed circular periphery having an annular landing strip surface 20 which is parallel to, but slightly higher than the outer surface 18. Riding on the annular landing strip 20 is a subsystem wheel 26. Axle shaft 24 extends through a hole in the center of the drum supporting hub 19 and extends into bearing 30 secured to housing 32. Axle shaft 24 extends through the center of another drum supporting hub (not shown) which is press fitted into the opposite end of imaging drum 12.

Figure 2:
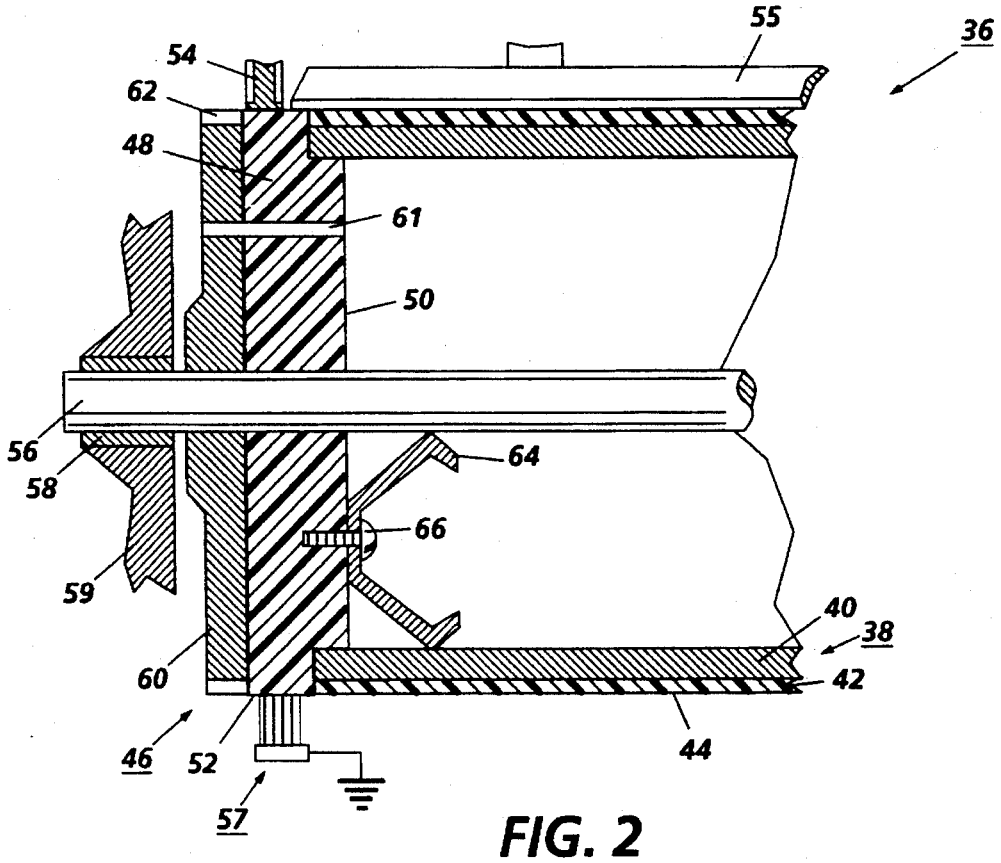
FIG. 2 is a schematic illustration of an electrostatographic imaging member assembly of this invention.

In FIG. 2, an electrostatographic imaging member assembly 36 is shown comprising a hollow electrostatographic imaging drum 38 which comprises a hollow cylindrical substrate 40 coated with imaging coating 42. Imaging coating 42 has an outer electrostatographic imaging surface 44. Electrostatographic imaging member assembly 36 also includes drum supporting hub 46 comprising a disk shaped segment 48 having a flange 50 which extends into the interior of and is concentric with the interior surface of cylindrical substrate 40. An annular landing strip surface 52 encircles the outer exposed surface of disk shaped segment 48. The exposed surface of annular landing strip surface 52 is parallel to and flush with outer electrostatographic imaging surface 44. Drum supporting hub 46 may comprise any suitable electrically conductive or electrically insulating material. Typical electrically conductive materials include, for example, metals, such as steel, stainless steel, aluminum, nickel, magnesium and magnesium-aluminum alloy; resins filled with electrically conductive particles such as carbon black; composite materials containing electrically conductive particles such as carbon fibers, metalic fibers; and the like. Typical electrically insulating materials include, for example, film-forming thermoplastic resins and thermosetting resins. Preferably, at least the surface of annular landing strip surface 52 of drum supporting hub 46 comprises a durable material that resists erosion by subsystem support wheel 54 during extensive cycling. Durability can be imparted to landing strip surface 52 by any suitable means. For example, a plasma sprayed coating of tungsten carbide, chromium oxide, or the like may be applied to cover landing strip surface 52, or, if drum supporting hub 46 comprises aluminum, at least the landing strip surface 52 may be hardened by anodization to form a thick aluminum oxide layer. Any other suitable treatment such as a chemical or heat treatment may be utilized to harden landing strip surface 52. Alternatively, the entire drum supporting hub 46 may be made of a hard material such as stainless steel, hardened tool steel or the like. By utilizing drum supporting hubs 46 having a durable material that resists erosion at at least landing strip surface 52, drum supporting hubs 46 will maintain close spacing tolerances during the entire life of electrostatographic imaging drum 12, prevent direct contacting wear between subsystem support wheel 54 and electrostatographic imaging drum 12, and permit simple recycling of both the used drum supporting hubs 46 and the used electrostatographic imaging drum 12. Preferably, for superior recycling life, at least landing strip surface 52 of supporting hub 46 has a Rockwell C Scale hardness value of at least about 30, if landing strip surface 52 comprises metallic materials.

Riding on annular landing strip surface 52 is subsystem support wheel 54. Generally, the width of annular landing strip surface 52 should be at least about three millimeters. This minimum width is required to prevent undue wear during frictional contact with supporting elements of imaging apparatus subsystems such as subsystem support wheel 54 during image cycling. There does not appear to be any critical maximum width for annular landing strip surface 52. However, unnecessary widths greater that the contacting width of subsystem support wheel 54 leads to waste of material, increases the overall width of the imaging apparatus and raises manufacturing costs. Typical widths for subsystem support wheel 54 or other subsystem support devices, include, for example, between about 3 millimeters and about 10 millimeters. If desired, other suitable support means may be employed in place of support wheel 54 such as a low coefficient of friction plastic housing leg, cam, seal or other mechanical means (not shown) extending from an imaging apparatus subsystem or other device or element. Electrostatographic imaging apparatus subsystems are well known and include, for example, developer housings, developer applicators, corotrons, cleaning blades, cleaning brushes, and the like, the support wheel 54 of the subsystem being shown in FIG. 2 as merely a representative example. Cleaning blade 55 is positioned to ride on imaging surface 44 and also partially on annular landing strip surface 52. By partially extending cleaning blade 55 onto annular landing strip surface 52, complete cleaning of the entire imaging surface 44 is achieved thereby allowing maximum utilization of substantially the entire outer surface of hollow electrostatographic imaging drum 38. If drum supporting hub 46 is electrically conductive, it may be utilized as an electrical connection between grounding brush 57, riding on annular landing strip surface 52, and conductive substrate 40. Grounding brush 55 may comprise any suitable conductive material such as, for example, carbon fibers or fine metallic fiber. Alternatively, a grounding roller (not shown) or the like may be utilized in place of grounding brush 57. Conductive grounding brush 57 may be used in combination with subsystem support wheel 54, or either subsystem support wheel 54 or conductive grounding brush 55 may be used without the other.

Axle shaft 56 extends through the center of drum supporting hub 46 and into bearing 58 carried by housing 59. The other end of axle shaft 56 extends through another hub (not shown) which may be similar or identical to hub 46. Hub 46 may be fixed to axle shaft 56 so that both rotate together or hub 46 may be freely rotatable around axle shaft 56. Hub 46 may be fixed to axle shaft 56 by any suitable and conventional means such as a set screw, key and slot arrangement (not shown) or the like. Attached to hub 46 is optional gear 60 having teeth 62 around its periphery. If desired, gear 60 may be formed as an integral part of hub 46 in a molding process. Alternatively, gear 60 may be separately formed and secured to hub 46 by any suitable and conventional means such as screws, bolts, adhesives, pins, interlocking tabs, or the like. If optional gear 60 is employed, it will normally by be used with a hub at one end of imaging drum 38 and not with the hub at the opposite end. Gear teeth 62 are adapted to engage with the teeth of another gear (not shown) connected to a suitable power source as is conventional in the art. Such an arrangement is well known in the art and is illustrated, for example, in U.S. Pat. No. 3,900,258 to R. F. Hoppner et al, the entire disclosure thereof being incorporated herein by reference. Alternatively, hub 46 may be driven directly by hexagonal or square axle shafts (not shown) which mate with correspondingly shaped openings in hub 46. Where hub 46 is fixed to axle shaft 56, shaft 56 may be driven directly by an electric motor (not shown) or by any other suitable power source, as is well known in the art.

An optional grounding clip 64 may be secured to disk shaped segment 48 of drum supporting hub 46 by any suitable means such as screw 66. Grounding clip 64 may be formed from any suitable electrically conductive and flexible material such as stainless steel, brass, copper beryllium, and the like. Grounding clip 64 should be maintained in frictional contact with electrically conductive axle shaft 56 and the interior surface of substrate 40 to electrically ground substrate 40 to electrically conductive axle shaft 56 as is well known in the art. Obviously, where hub 46 is electrically conductive rather than electrically insulating, hub 46 may itself function as an electrical connection between drum substrate 40 and electrically conductive axle shaft 56. Thus, ground clip 64 is optional and may be utilized where hub 46 is fabricated from electrically insulating material.

Two hubs 46, each having an annular landing strip surface 52, are employed to support a subsystem support element, such as subsystem support wheel 54, because both ends of hollow cylindrical substrate 40 of electrostatographic imaging drum 38 are coated to the very ends of substrate 40. If cylindrical substrate 40 is not totally submerged during dip coating, an uncoated band around substrate 40 will remain which reduces that amount of imaging area available on the exterior surface of substrate 40 and induces the upper coating boundary problem described above where the applied coating layer near the coating boundary tends to have a nonuniform thickness and non-uniform electrical properties. The hubs 46 of this invention mounted onto each end of drum 38 may be identical in shape or different. However, each hub 46 must have an annular landing strip surface 52 having a width of at least about three millimeters and the annular landing strip surface 52 must be parallel to and flush with outer electrostatographic imaging surface 44 in order to achieve full use of substantially the entire outer surface of drum 38 for electrostatographic imaging and to secure uniform electrical and physical properties from one end of drum 38 to the other end.

Any suitable arrangement may be utilized to position drum supporting hub 46 at the end of imaging drum 38. For example, the inner surface of disc shaped segment 48 of hub 46 may serve as a landing which abuts and aligns with the squared face at the adjacent end of imaging drum 38. Annular landing strip surface 52 on the exterior surface of disk shaped segment 48 is preferably smooth to minimize wear and vibration. A smooth surface can also compensate for cylindrical substrates 40 having a somewhat rough exterior surface which could cause wear and vibration if subsystem support wheel 54 rode directly on such rough exterior surface instead of on smooth annular landing strip surface 52. Disc shaped segment 48 may optionally contain one or more bleed holes 61 to facilitate mounting or dismounting of hub 46 from an end of imaging drum 38.

Hubs 46 may be mounted onto the ends of imaging drum 38 by any suitable technique. For example, flange 50 may be slid into the interior of cylindrical substrate 40 at an end of imaging drum 38 with the aid of pressure applied to flange 50 with the applied pressure having a component in a direction parallel to the axis of imaging drum 38, e.g. hub 46 can be applied with a twisting motion into drum 38. The outer circumference of flange 50 relative to the inner circumference of substrate 40 can be selected to achieve a friction or interference fit. The relative size of these circumferences selected will depend upon a number of factors such as the type of texture employed for the outer contacting surface of flange 50 and the technique employed for mounting. For example, the outer contacting surface of flange 50 and/or inner contacting surface of flange 50 may be smooth, roughened or the like. An optional mounting technique involves applying an adhesive onto the outer contacting surface of flange 50 by any suitable process such as brushing, extruding or spraying and slowly sliding flange 50 into one end of drum 38. Little or no interference friction fit is needed for this optional adhesive technique. Any suitable thermoplastic or thermosetting film forming adhesive may be utilized. Typical adhesives include, for example, epoxy resin, cyanoacrylate, silicones, and the like.

The invention has been described in detail with particular reference to preferred embodiments thereof but it will be understood that variations and modifications can be effected within the spirit and scope of the invention as described herein above and as defined in the appended claims.

What is claimed is:

1. Apparatus for electrostatographic imaging comprising an electrostatographic imaging member assembly comprising a hollow electrostatographic imaging drum having a first end and a second end, at least one coating on said drum extending from said first end of said drum to said second end of said drum, said coating having an outer electrostatographic imaging surface, drum supporting hubs mounted on said first end of said drum and said second end of said drum, said drum supporting hubs comprising a disk shaped member comprising a disk shaped segment having an exposed annular landing strip surface parallel to and flush with said electrostatographic imaging surface, said annular landing strip surface having a width of at least about 3 millimeters and having an imaginary axis coextensive with an imaginary axis of said drum, and a developer applicator unit in contact with said annular landing strip surface of each of said hubs.

2. Apparatus for electrostatographic imaging comprising an electrostatographic imaging member assembly comprising a hollow electrostatographic imaging drum having a first end and a second end, at least one coating on said drum extending from said first end of said drum to said second end of said drum, said coating having an outer electrostatographic imaging surface, drum supporting hubs mounted on said first end of said drum and said second end of said drum, said drum supporting hubs comprising a disk shaped member comprising a disk shaped segment having an exposed annular landing strip surface parallel to and flush with said electrostatographic imaging surface, said annular landing strip surface having a width of at least about 3 millimeters and having an imaginary axis coextensive with an imaginary axis of said drum, and a corona charging unit in contact with said annular landing strip surface of each of said hubs.

3. Apparatus for electrostatographic imaging according to claim 2 wherein said hubs are adhesively secured to said drum.

4. Apparatus for electrostatographic imaging according to claim 2 wherein said hubs comprise a circular flange extending into and frictionally engaging the interior of said hollow drum.

5. A process for fabricating an electrostatographic imaging member assembly comprising providing a hollow electrostatographic imaging drum substrate having a first end, a second end, an interior surface and an external surface, applying a coating to said substrate by submerging said first end of said drum substrate in a coating solution of a filming forming polymer while maintaining the axis of said drum substrate in a vertical orientation until all of said external drum substrate surface is submerged into and coated with said coating solution to said second end, drying said coating, mounting drum supporting hubs onto said first end of said drum and said second end of said drum, said drum supporting hubs comprising a disk shaped member comprising a disk shaped segment having an exposed annular landing strip surface parallel to and flush with said electrostatographic imaging surface, said annular landing strip surface having a width of at least about 3 millimeters and having an imaginary axis coextensive with an imaginary axis of said drum and bringing a corona charging unit into contact with said annular landing strip surface of each of said hubs.

6. A process for fabricating an electrostatographic imaging member assembly comprising providing a hollow electrostatographic imaging drum substrate having a first end, a second end, an interior surface and an external surface, applying a coating to said substrate by submerging said first end of said drum substrate in a coating solution of a filming forming polymer while maintaining the axis of said drum substrate in a vertical orientation until all of said external drum substrate surface is submerged into and coated with said coating solution to said second end, drying said coating, mounting drum supporting hubs onto said first end of said drum and said second end of said drum, said drum supporting hubs comprising a disk shaped member comprising a disk shaped segment having an exposed annular landing strip surface parallel to and flush with said electrostatographic imaging surface, said annular landing strip surface having a width of at least about 3 millimeters and having an imaginary axis coextensive with an imaginary axis of said drum and bringing a developer applicator unit into contact with said annular landing strip surface of each of said hubs.

7. A process according to claim 6 including providing a metallic exposed annular landing strip surface on each of said hubs, said surface having a Rockwell C Scale value of at least about 30.

* * * * *